US006513741B2

(12) United States Patent
Hsu

(10) Patent No.: US 6,513,741 B2
(45) Date of Patent: Feb. 4, 2003

(54) SHREDDING MACHINE

(76) Inventor: Liang-Ching Hsu, 4F, N0607-1, Hsin Shu Rd., Shin Chuang, Taipei Hsien (TW)

( * ) Notice: Subject to any disclaimer, the term of this patent is extended or adjusted under 35 U.S.C. 154(b) by 112 days.

(21) Appl. No.: 09/819,526

(22) Filed: Mar. 27, 2001

(65) Prior Publication Data

US 2002/0139881 A1 Oct. 3, 2002

(51) Int. Cl.[7] ..... B02C 1/08
(52) U.S. Cl. ..... 241/236; 241/166; 241/243
(58) Field of Search ..... 241/101.2, 166, 241/235, 236, 243, 296, 292.1

(56) References Cited

U.S. PATENT DOCUMENTS 4,194,698 A * 3/1980 Kosmowski ..... 241/236
4,982,907 A * 1/1991 Sedgwick et al. ..... 241/236
5,295,633 A * 3/1994 Kimbro et al. ..... 241/166
5,826,809 A * 10/1998 Kroger ..... 241/236 X
6,113,017 A * 9/2000 Tsai ..... 241/236

* cited by examiner

*Primary Examiner*—W. Donald Bray
(74) *Attorney, Agent, or Firm*—Pro-Techtor International Services

(57) ABSTRACT

A shredding machine includes a plurality of locating plates respectively mounted on two revolving axles between two side frames, pairs of spring washers respectively mounted on the revolving axles between each two locating plates to hold a respective annular cutter for cutting inserted paper into shreds upon the operation of a motor to rotate the revolving axles through a transmission gear train, two support rods connected in parallel between the side frames at two sides, and two locating frames connected between the side frames and respectively supported on the support rods, the locating frames each having a protruded middle portion engaged into a retaining notch of each of the locating plates to stop the locating plates from rotation with the revolving axles and to further stop the annular cutters from deformation during cutting.

2 Claims, 4 Drawing Sheets

SHREDDING MACHINE

BACKGROUND OF THE INVENTION

The present invention relates to a shredding machine and, more particularly to a durable shredding machine, which stops the cutters from outward deformation during cutting.

A shredding machine is known comprising two side frames, two revolving axles connected in parallel between the side frames, a plurality of locating plates respectively sleeved onto the revolving axles, pairs of spring washers respectively mounted on the revolving axles between each two adjacent locating plates, a plurality of annular cutters respectively fixedly mounted on the revolving axles and arranged between each two spring washers, a motor fixedly mounted on one side frame, and a transmission mechanism controlled to rotate the revolving axles, causing the annular cutters to cut inserted paper into shreds. This structure of shredding machine is functional, however it is not durable in use. During cutting, the annular cutters tend to be forced to deform by the resisting force from the inserted paper. When the annular cutters are permanently deformed, they may become unable to cut inserted paper into shreds.

SUMMARY OF THE INVENTION

The present invention has been accomplished to provide a shredding machine, which eliminates the aforesaid problem. According to the present invention, two locating frames are connected between the side frames of the shredding machine and supported on a respective support rod to stop the locating plates from rotary motion relative to the revolving axles of the shredding machine. The locating frames each have a protruded middle portion respectively engaged into a retaining notch of each of the locating plates. Because the locating plates are positively supported on the locating frames, the spring washers are positively supported on the locating plates to stop the annular cutters from deformation when the annular cutters are respectively rotated with the revolving axles to cut inserted paper into shreds.

DETAILED DESCRIPTION OF THE PREFERRED EMBODIMENT

Figure 1:
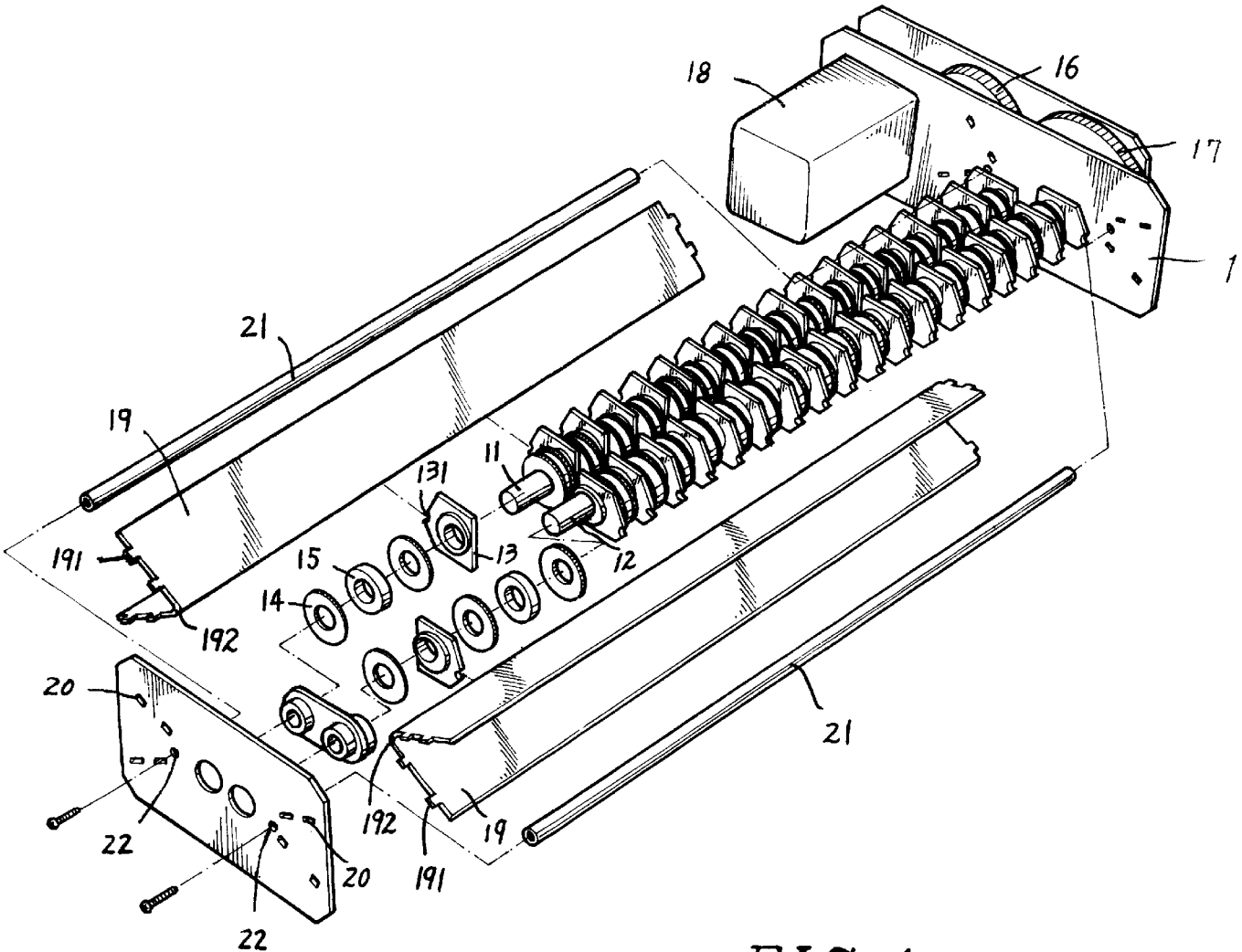
FIG. 1 is an exploded view of a shredding machine according to the present invention.
Figure 2:
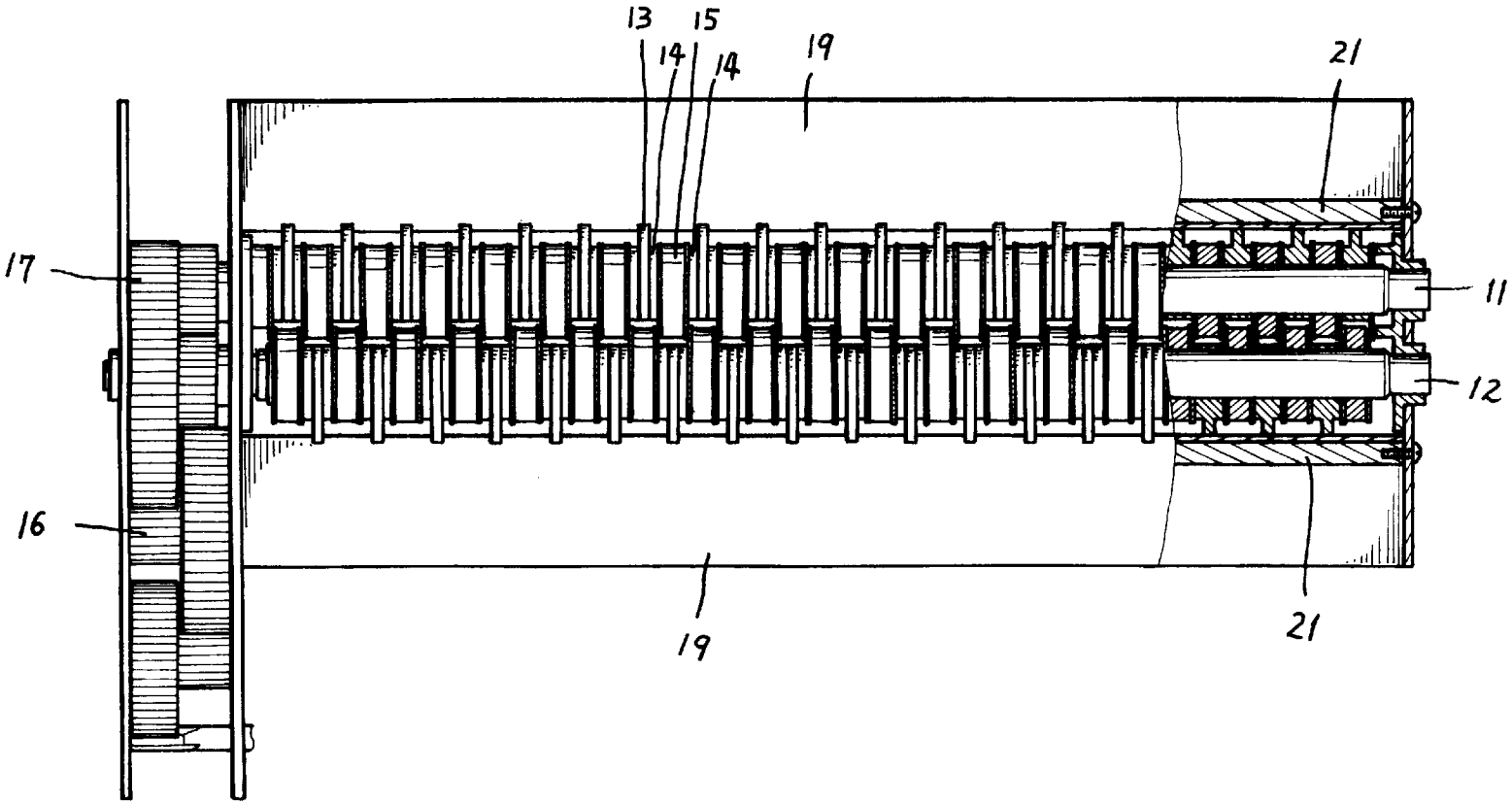
FIG. 2 is a top view of the shredding machine according to the present invention.

Referring to FIGS. 1 and 2, a shredding machine is shown comprising two side frames, two revolving axles 11 and 12 revolvably supported between the side frames 11, a plurality of locating plates 13 respectively sleeved onto the revolving axles 11 and 12 and equally spaced from one another on each of the revolving axles 11 and 12, a plurality of spring washers 14 respectively sleeved onto the revolving axles 11 and 12 and arranged in pair between each two adjacent locating plates 13, a plurality of annular cutters 15 respectively and fixedly fastened to the revolving axles 11 and 12 between each pair of spring washers 14, a motor 18 fixedly mounted on one side frame 1, and a transmission gear train 16 and 17 respectively mounted on one side frame 1 and driven by the motor 18 to rotate the revolving axles 11 and 12. When starting the motor 18, the annular cutters 15 are respectively rotated with the revolving axles 11 and 12 to cut inserted paper into shreds.

Referring to FIGS. 1 and 2 again, the side frames 1 each comprise a plurality of plug holes 20, and two screw holes 22. Two support rods 21 are connected between the side frames 1, each having two distal ends respectively fixedly fastened to the screw holes 22 of the side frames 1 by screws. Two locating frames 19 are connected between the side frames 1 and respectively supported on the support rods 21. The locating frames 19 are <-shaped plate members, each having a protruded middle portion 192 supported on one support rod 21, and a plurality of end plug rods 191 respectively press-fitted into the plug holes 20 of the side frames 1. The locating plates 13 each have retaining notch 131 disposed at the respective protruded outer end and forced into engagement with the protruded middle portion 192 of one locating frame 19.

Figure 3:
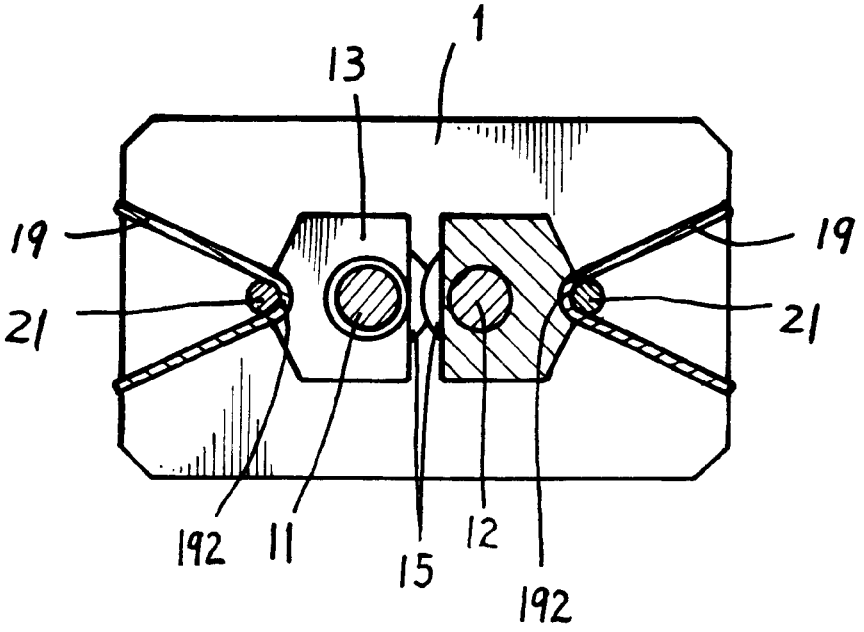
FIG. 3 is a sectional view of the shredding machine according to the present invention.
Figure 4:
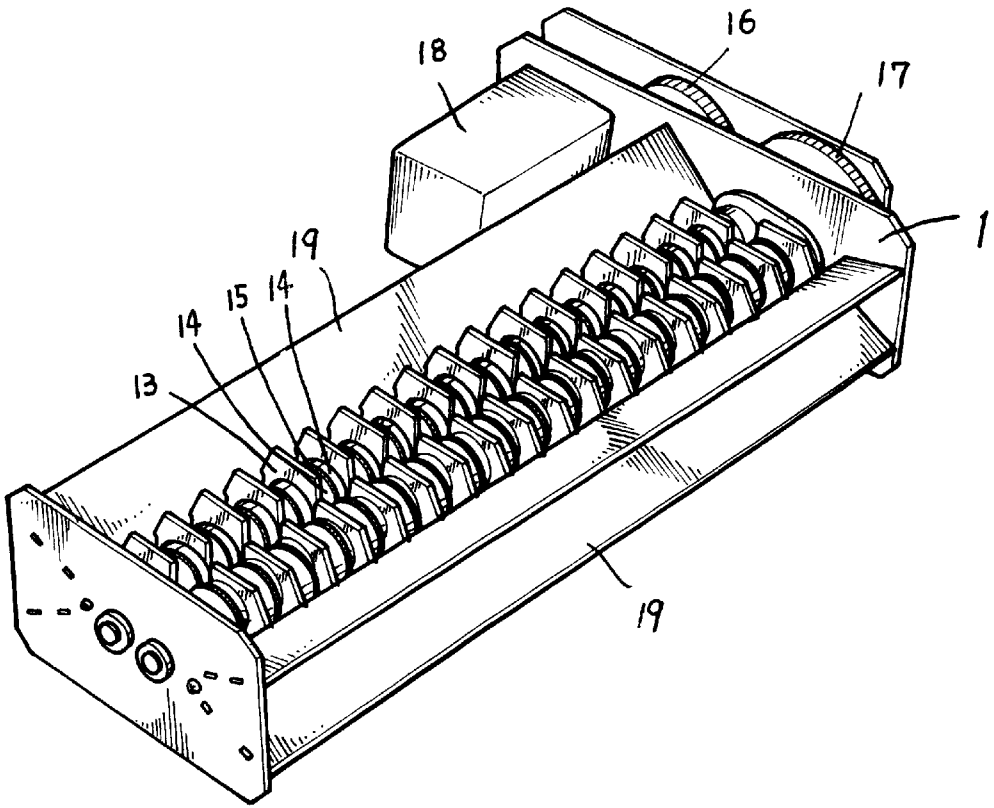
FIG. 4 is a perspective assembly view of the shredding machine according to the present invention.

Referring to FIGS. 3 and 4, when assembled, the locating frames 19 are respectively supported on the support rods 21 between the side frames 1, the locating plates 13 are respectively supported on the revolving axles 11 and 12 and the locating frames 19 without affecting rotation of the revolving axles 11 and 12, and the annular cutters 15 are respectively supported between each two spring washers 14 and rotated with the revolving axles 11 and 12 to cut inserted paper into shreds upon during the operation of the motor 18. Because the retaining notch 131 of each of the locating plates 13 is respectively engaged with the protruded middle portion 192 of each of the locating frames 19, the locating plates 13 and the spring washers 14 support the annular cutters 15 from outward deformation during cutting.

A prototype of shredding machine has been constructed with the features of FIGS. 1~4. The shredding machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A shredding machine comprising two side frames, two revolving axles connected in parallel between said side frames, a plurality of locating plates respectively sleeved onto said revolving axles, pairs of spring washers respectively mounted on said revolving axles between each two adjacent locating plates, a plurality of annular cutters respectively fixedly mounted on said revolving axles and arranged between each two spring washers, a motor fixedly mounted on one side frame, and a transmission gear train driven by said motor to rotate said revolving axles, wherein two support rods are connected between said side frames and arranged at two sides of said revolving axles; two locating frames are connected between said side frames and respectively supported on said support rods to stop said locating plates from rotation with said revolving axles, said locating frames each having a protruded middle portion; said locating plates each have a retaining notch disposed at one end and forced into engagement with the protruded middle portion of one of said locating frames.

2. The shredding machine of claim 1 wherein said side frames each have a plurality of plug holes, and said locating frames each have a plurality of end plugs respectively press-fitted into the plug holes of said side frames.

* * * * *